US009399894B2

(12) United States Patent
Perry

(10) Patent No.: US 9,399,894 B2
(45) Date of Patent: Jul. 26, 2016

(54) FRICTION REDUCING DOWNHOLE ASSEMBLIES

(71) Applicant: PREMIER ADVANCED SOLUTION TECHNOLOGIES, LLC, Youngsville, LA (US)

(72) Inventor: Kenneth Perry, Youngsville, LA (US)

( * ) Notice: Subject to any disclaimer, the term of this patent is extended or adjusted under 35 U.S.C. 154(b) by 215 days.

(21) Appl. No.: 14/209,315

(22) Filed: Mar. 13, 2014

(65) Prior Publication Data

US 2014/0262216 A1 Sep. 18, 2014

Related U.S. Application Data

(60) Provisional application No. 61/781,167, filed on Mar. 14, 2013.

(51) Int. Cl.
*E21B 17/10* (2006.01)

(52) U.S. Cl.
CPC ..... *E21B 17/1014* (2013.01); *E21B 17/1057* (2013.01)

(58) Field of Classification Search
CPC ..... E21B 17/1057; E21B 17/1064; E21B 17/1014; E21B 17/1021; E21B 17/1078; E21B 17/1007; E21B 17/10; E21B 7/62; E21B 17/1028
See application file for complete search history.

(56) References Cited

U.S. PATENT DOCUMENTS

| | | | | |
|---|---|---|---|---|
| 2,119,095 | A * | 5/1938 | Brummett | 175/73 |
| 3,476,196 | A * | 11/1969 | Whittle et al. | 175/325.4 |
| 4,243,099 | A | 1/1981 | Rodgers, Jr. | |
| 4,989,679 | A * | 2/1991 | Amaudric du Chaffaut | 175/325.3 |
| 5,358,042 | A | 10/1994 | Stoltz | |
| 5,941,323 | A * | 8/1999 | Warren | 175/74 |
| 6,920,936 | B2 | 7/2005 | Sheiretove et al. | |
| 7,845,061 | B2 | 12/2010 | Buytaert et al. | |
| 2003/0150611 | A1* | 8/2003 | Buytaert | 166/241.6 |
| 2008/0196901 | A1 | 8/2008 | Aguirre et al. | |
| 2012/0205093 | A1* | 8/2012 | Paszek | 166/241.6 |
| 2012/0255744 | A1* | 10/2012 | Shaikh et al. | 166/380 |
| 2013/0186690 | A1* | 7/2013 | Surjaatmadja et al. | 175/57 |
| 2014/0311756 | A1* | 10/2014 | Dicke | 166/381 |

OTHER PUBLICATIONS

PCT International Search Report and Written Opinion Aug. 8, 2014.

* cited by examiner

*Primary Examiner* — Blake Michener
*Assistant Examiner* — Kipp Wallace
(74) *Attorney, Agent, or Firm* — Ted M. Anthony

(57) ABSTRACT

A friction reducing assembly has a substantially cylindrical body member having an outer surface and friction reducing elements, such as ball transfer units or other omni-directional rolling-element bearing assemblies, disposed along such outer surface. The friction reducing assembly can take many different configurations including a rolling sub assembly, a mule shoe assembly or a centralizer assembly having an adjustable outer diameter.

11 Claims, 9 Drawing Sheets

FRICTION REDUCING DOWNHOLE ASSEMBLIES

CROSS REFERENCES TO RELATED APPLICATION

Priority of U.S. Provisional Patent application Ser. No. 61/781,167, filed Mar. 14, 2013, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to downhole assemblies having friction reducing elements. More particularly, the present invention pertains to dowhole assemblies having at least one friction reducing element on at least one exterior surface to reduce frictional forces acting on said assemblies. More particularly still, the present invention pertains to downhole assemblies having at least one ball transfer unit on at least one exterior surface.

2. Brief Description of the Prior Art

During operations in the oil and gas industry, a pipe or substantially tubular tool having a certain outer diameter is frequently inserted or otherwise received within a wellbore or pipe having a larger inner diameter. Such operations are often performed during both drilling and production phases of a well's life cycle. By way of illustration, but not limitation, drill pipe, casing and other tubular goods are routinely run into cased and uncased wellbores. Similarly, tools and other downhole assemblies are often conveyed in and out of wells via jointed pipe, continuous (spooled) tubing and/or wireline.

In such cases, frictional forces—typically so-called "sliding friction—from surrounding surfaces acting on such inner pipe or tool(s) can impede such inner pipe or tool(s) from advancing further into a well. In order to reduce or lessen such frictional forces, friction reducing assemblies can be utilized. In most cases, such friction reducing assemblies are installed on at least one outer surface of a tubular or assembly that is being conveyed into a well.

Various types of friction-reducing devices including, without limitation, so-called "roller subs," are currently used throughout the oil and gas industry in an effort to reduce or limit such sliding friction. Conventional roller subs typically comprise substantially cylindrical body members having radial slots at predetermined intervals. Rollers and/or wheels are rotatably disposed within said slots. In many cases, such roller subs are modular in construction; as such, the roller subs can be assembled in a manner to secure the rollers and/or roller wheels in place, avoiding the need for grub screws and facilitating relatively compact dimensions.

Although such devices can be used in many different applications, use of roller subs is especially prevalent during downhole wireline operations. Such wireline operations generally rely on gravity alone in order to advance a toolstring in a well. As such, roller subs can be especially useful in directional wellbores that deviate substantially from vertical. Roller subs help to reduce sliding friction, thereby allowing wireline tools to advance deeper within a well.

During drilling of a well, stabilizers may be coupled into a drill string to bear against a wall of a drilled hole and thus centralize a drill string in a wellbore. After a well has been drilled, devices known as centralizers may also be employed to centrally locate a liner or casing within a well and provide "stand off" from a surrounding wellbore or casing. Conventional roller subs are also used to reduce sliding friction associated with devices such as stabilizers and centralizers. However, such conventional roller subs are typically not adjustable to various conditions within a well such as, for example, wells having multiple internal diameters.

One type of conventional stabilizer rolling sub assembly comprises rollers mounted on multiple axes, which are each parallel to a longitudinal axis of a stabilizer body (and, hence, also parallel to the longitudinal axis of a drillstring and of a well drilled thereby). The functional effect associated with this form of stabilizer is to reduce rotational friction, while having a neutral or even adverse effect on longitudinal sliding frictional forces.

Conventional roller subs are also sometimes run in connection with bow spring centralizers to reduce sliding friction. However, such bow spring centralizers are typically not sturdy enough to support the full weight of tubing, casing or other pipe strings. Additionally, such conventional centralizer roller subs typically include axles, grub screws and/or other mechanical components that are especially vulnerable to failure during use.

Thus, there is a need for a friction reducing apparatus that significantly reduces frictional forces acting upon tubulars, tool strings, centralizers and/or other downhole assemblies. Such friction reducing apparatus must reduce or diminish frictional forces including, without limitation, sliding friction, generated between outer surface(s) of a pipe or tool, and inner surfaces of a surrounding wellbore or tubular. Among other benefits, the friction reducing apparatus should beneficially assist pipe or downhole tools to traverse obstructions or so-called "tight spots" within a wellbore, minimize or eliminate damage caused when said pipes or downhole tools scrape against surrounding wellbore walls, and reduce rotational friction forces and pipe torsional strain.

SUMMARY OF THE INVENTION

In a preferred embodiment, the present invention comprises a substantially cylindrical body member having an outer surface and a plurality of friction reducing elements disposed at least partially along said outer surface. Although many different friction reducing elements can be utilized, said elements can beneficially comprise ball transfer units or other omni-directional rolling-element bearing assemblies.

Although the present invention can take many different configurations, in a preferred embodiment the present invention can comprise a rolling sub assembly, a mule shoe assembly or a centralizer assembly. The friction reducing assembly of the present invention comprises a body section having an outer surface with at least one pocket or recess. At least one ball transfer unit or other omni-directional rolling-element bearing is singly mounted in said at least one pocket or recess, and extends at least partially beyond said outer surface of body section.

The rolling sub, mule shoe and centralizer assemblies of the present invention can be used in many different applications and industries. By way of illustration, but not limitation, the assemblies of the present invention can be used in subterranean well drilling and related operations (water, oil and/or gas wells), mining, deviated holes for construction purposes, quarry drilling, and pipe cleaning. Further, the friction reducing assemblies of the present invention, having much smaller dimensions, can also be used in various medical applications.

When utilized in oil and/or gas wells, the friction reducing assemblies of the present invention provide a number of significant operational benefits. Specifically, the friction reducing assemblies of the present invention allow pipe deployment in highly-deviated and/or horizontal wellbores. Said friction reducing assemblies substantially reduce rotational friction and torque in horizontal and diagonal planes, while reducing sliding friction and drag in vertical and diagonal planes. Further, although conventional roller subs typically only permit rotation about a longitudinal axis, the friction reducing assemblies of the present invention permit full 360-degree rotational contact between friction reducing elements and surrounding well or other surfaces.

Additionally, the friction reducing assemblies of the present invention reduce pipe wear and fatigue during deployment (and retrieval, if necessary), while also reducing or eliminating damage to liner tops and liners. Said assemblies permit deployment of tools conveyed via wireline and/or continuous tubing in highly deviated and horizontal wells, while reducing the risk of damage to exposed packer slips and seals.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

The present invention comprises an adjustable tension centralizer assembly 100 having a plurality of omni-directional rolling-element bearings that assist the delivery of a centralized tool, pipe section, tubular good, tool, or other device. More particularly, adjustable tension centralizer assembly 100 comprises an adjustable device having friction reducing rolling elements disposed in radially extendable arms. Said friction reducing elements contact and reduce frictional forces against the inner surface of a surrounding casing, hole, pipe or other surrounding enclosure. The adjustable centralizer assembly 100 of the present invention can be included within a larger pipe assembly using threaded connections, set screws, or other connection means well known to those having skill in the art.

Figure 1:
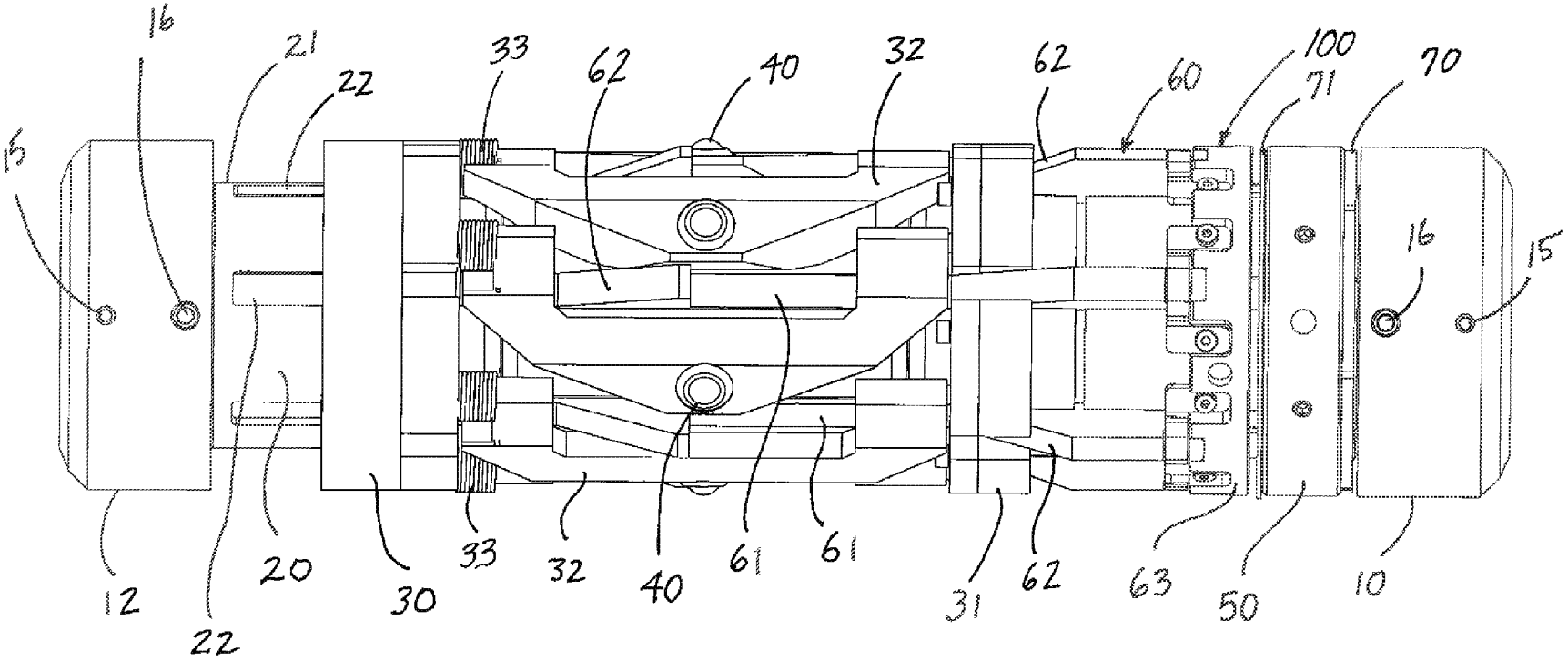
FIG. 1 depicts a side view of a centralizer assembly (sometimes referred to herein as "Adjustable Tension Centralizer Assembly" or "ATCA") of the present invention with radially extending arms in a substantially collapsed position.

Referring to the drawings, FIG. 1 depicts a side view of an adjustable tension centralizer assembly 100 of the present invention. In a preferred embodiment, said adjustable tension centralizer assembly 100 comprises first end connection member 10 having central through bore 11, as well as second end connection member 12 having central through bore 13. Said first and second connection members, and their respective central through bores, are substantially axially aligned with each other.

Substantially cylindrical body member 20 is disposed between said first end connection member 10 and second end connection member 12. Said substantially cylindrical body member 20 has outer surface 21 and central through bore 23. A plurality of elongate grooves 22 are disposed at desired spacing around the circumference of said outer surface 21; said elongate grooves 22 are oriented substantially parallel to the longitudinal axis of said body member 20. In a preferred embodiment, substantially cylindrical body member 20 is freely rotatable within said aligned bores 11 and 13 of end connection members 10 and 12, respectively.

First centralizer end collar 30 and second centralizer end collar 31 are disposed around said cylindrical body member 20 and spaced a desired distance apart from each other. A plurality of generally u-shaped centralizer arm members 32 are disposed between said first and second centralizer end collars and pivotally mounted to said first and second end collars. Said centralizer arm members 32 are pivotal about a pivot axis that is oriented substantially parallel to the longitudinal axis of said body member 20. As such, said centralizer arm members 32 are capable of pivoting radially outward from outer surface 21 of body member 20.

Still referring to FIG. 1, at least one friction reducing omni-directional rolling element 40 is disposed on an outer surface of each such centralizer arm member 32. In a preferred embodiment, said friction reducing omni-directional rolling elements 40 comprise ball transfer units. Further, bias springs 33 can be beneficially provided to bias said centralizer arm members 32 in an inward or closed position (that is, generally toward or against central body member 20).

Adjustable collar member 50 is slidably disposed on outer surface 21 of central body member 20 and, thus, is capable of moving axially along said central body member 20. Although not depicted in FIG. 1, in a preferred embodiment, mating threads are disposed on the inner surface of said adjustable collar member 50 and outer surface 21 of body member 20, such that rotation of adjustable collar member 50 causes said collar member 50 to move axially along the length of said central body member 20.

Wedge assembly 60 comprises base ring 63 as well as a plurality of track arms 61. Base ring 63 is slidably disposed over outer surface 21 of central body member 20, while track arms 61 are slidably received within longitudinal grooves 22 along said outer surface 21 of body member 20. Spring 71 can be disposed between base ring 63 and collar member 50. Wedge latch member 70 having collet fingers 73 can extend under collar member 50 and connect to wedge assembly 60.

Tapered wedge members 62 are disposed on the outer surfaces of track arms 61; in a preferred embodiment, said wedge members 62 have a smaller thickness in the direction of first end connector 10, and a larger thickness in the direction of second end connector 12. Further, said tapered wedge members 62 are at least partially disposed under pivotally mounted centralizer arm members 32 (that is, between outer surface 21 of central body member 20 and said centralizer arm members 32).

Figure 2:
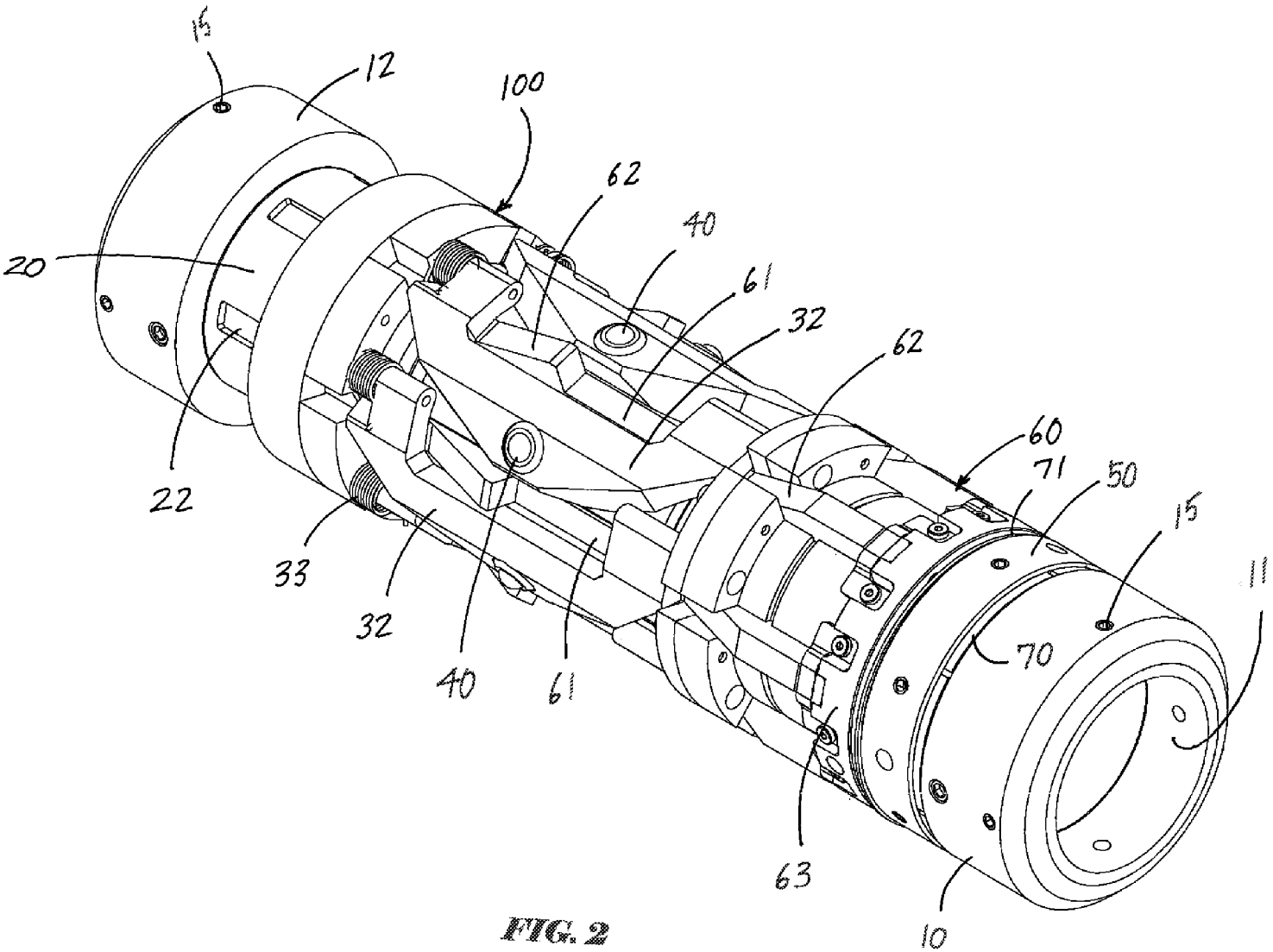
FIG. 2 depicts a side perspective view of an adjustable tension centralizer assembly of the present invention with radially extending arms in a substantially collapsed position.

FIG. 2 depicts a side perspective view of an adjustable tension centralizer assembly 100 of the present invention with radially disposed centralizer arm members 32 in a substantially collapsed position. As depicted in FIG. 2, said adjustable tension centralizer assembly 100 comprises first end connection member 10 having central through bore 11, as well as second end connection member 12 (also having a central through bore 13, not visible in FIG. 2).

Substantially cylindrical body member 20 having outer surface 21 and central through bore 23 is rotatably disposed between said first end connection member 10 and second end connection member 12. A plurality of elongate grooves 22, oriented substantially parallel to the longitudinal axis of said body member 20, are disposed at desired radial spacing around the circumference of said outer surface 21. Opposing first centralizer end collar 30 and second centralizer end collar 31 are disposed around said cylindrical body member 20 and spaced a desired distance apart from each other.

A plurality of generally u-shaped centralizer arm members 32 are disposed between said first and second centralizer end collars 30 and 31, and are pivotally mounted at both ends to said first and second end collars. At least one friction reducing omni-directional rolling element 40 is disposed on an outer surface of each such centralizer arm member 32. Bias springs 33 bias said centralizer arm members 32 in a closed or radially inward direction.

Adjustable collar member 50 is slidably disposed on outer surface 21 of central body member 20. Wedge assembly 60 comprises base ring 63 as well as a plurality of track arms 61. Base ring 63 is slidably disposed over outer surface 21 of central body member 20, while track arms 61 are slidably received within longitudinal grooves 22 along said outer surface 21 of body member 20. Tapered wedge members 62 are disposed on the outer surfaces of track arms 61 and are at least partially disposed between outer surface 21 of central body member 20 and said centralizer arm members 32.

Figure 3:
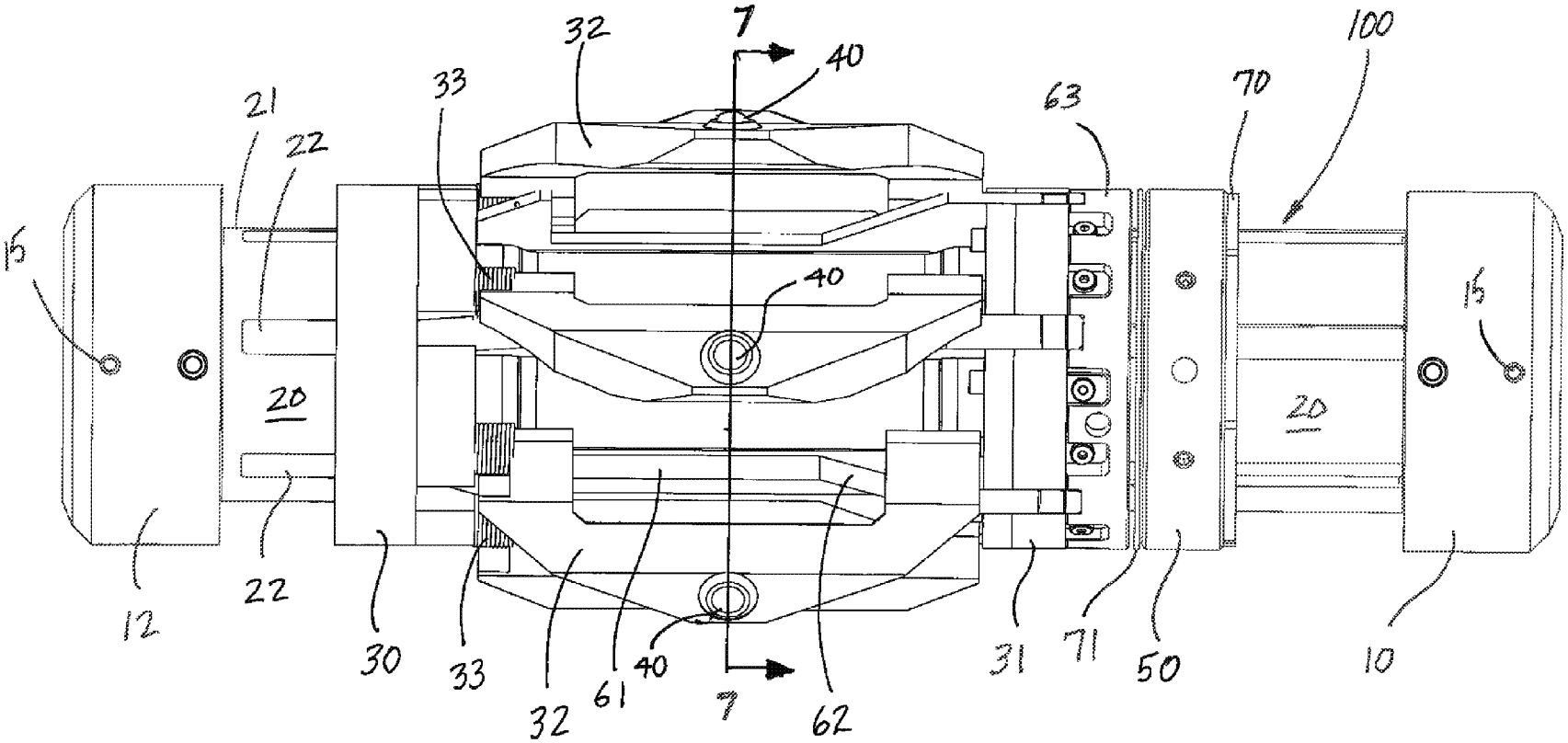
FIG. 3 depicts a side view of an adjustable tension centralizer assembly of the present invention with radially extending arms in a partially extended position.

FIG. 3 depicts a side view of adjustable tension centralizer assembly 100 of the present invention with radially extending centralizer arm members 32 in a partially extended position. Adjustable collar member 50 and wedge base ring 63 can be moved axially along said central body member 20 and locked in place. Axial movement of said adjustable collar member 50 and wedge base ring 63 in turn causes axial movement of wedge assembly 60 along the length of said central body member 60.

Figure 4:
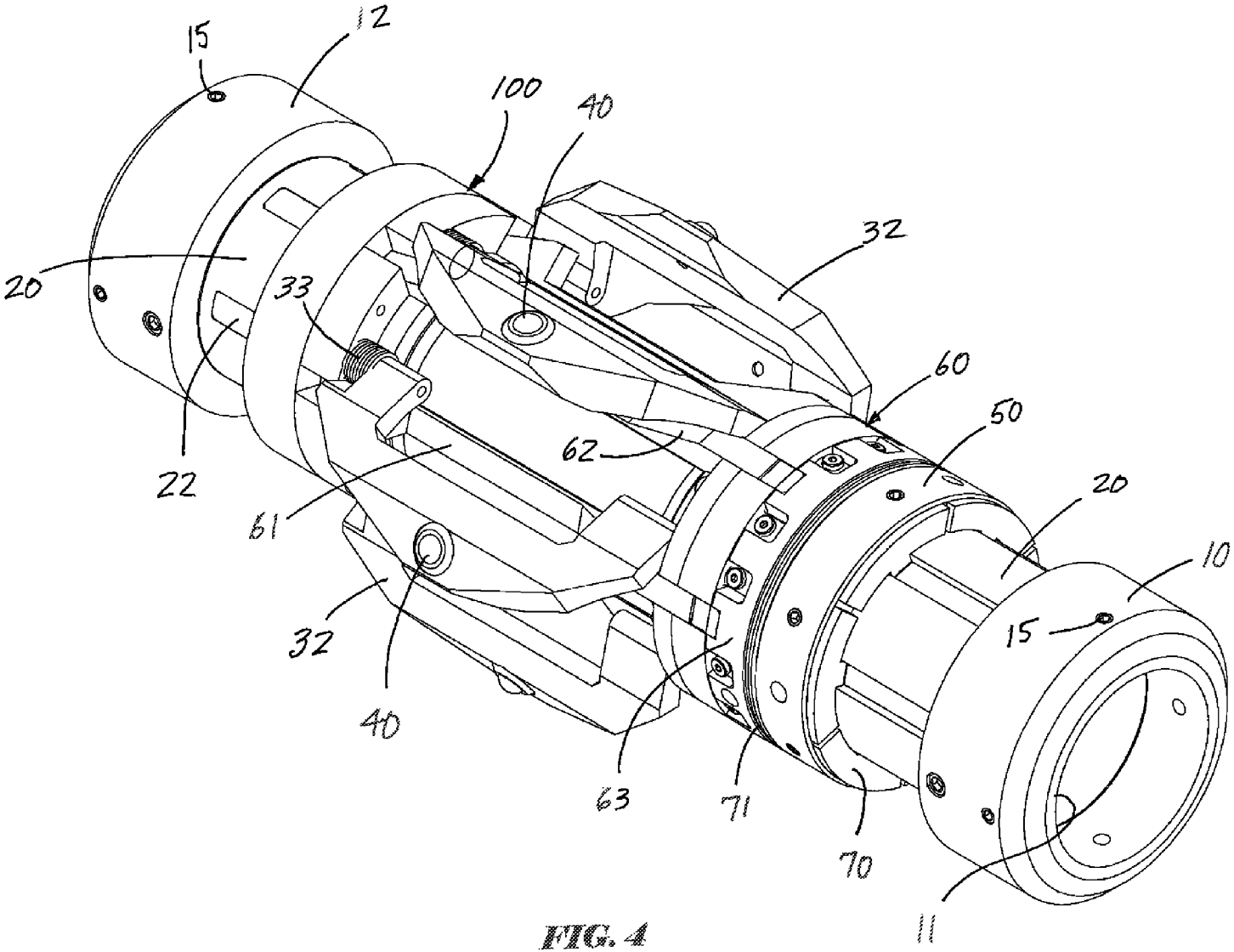
FIG. 4 depicts a side perspective view of an adjustable tension centralizer assembly of the present invention with radially extending arms in a partially extended position.

FIG. 4 depicts a side perspective view of adjustable tension centralizer assembly 100 of the present invention with radially extending centralizer arm members 32 in a partially extended position. As said adjustable collar 50 and wedge assembly 60 move axially along the length of said central body member 20, track arms 61 of wedge assembly 60 also move within longitudinal grooves 22 along said outer surface 21 of body member 20. Tapered wedge members 62 likewise move under pivotally mounted centralizer arm members 32 (that is, between outer surface 21 of central body member 20 and said centralizer arm members 32), thereby forcing said centralizer arm members 32 to pivot and extend radially outward.

Figure 5:
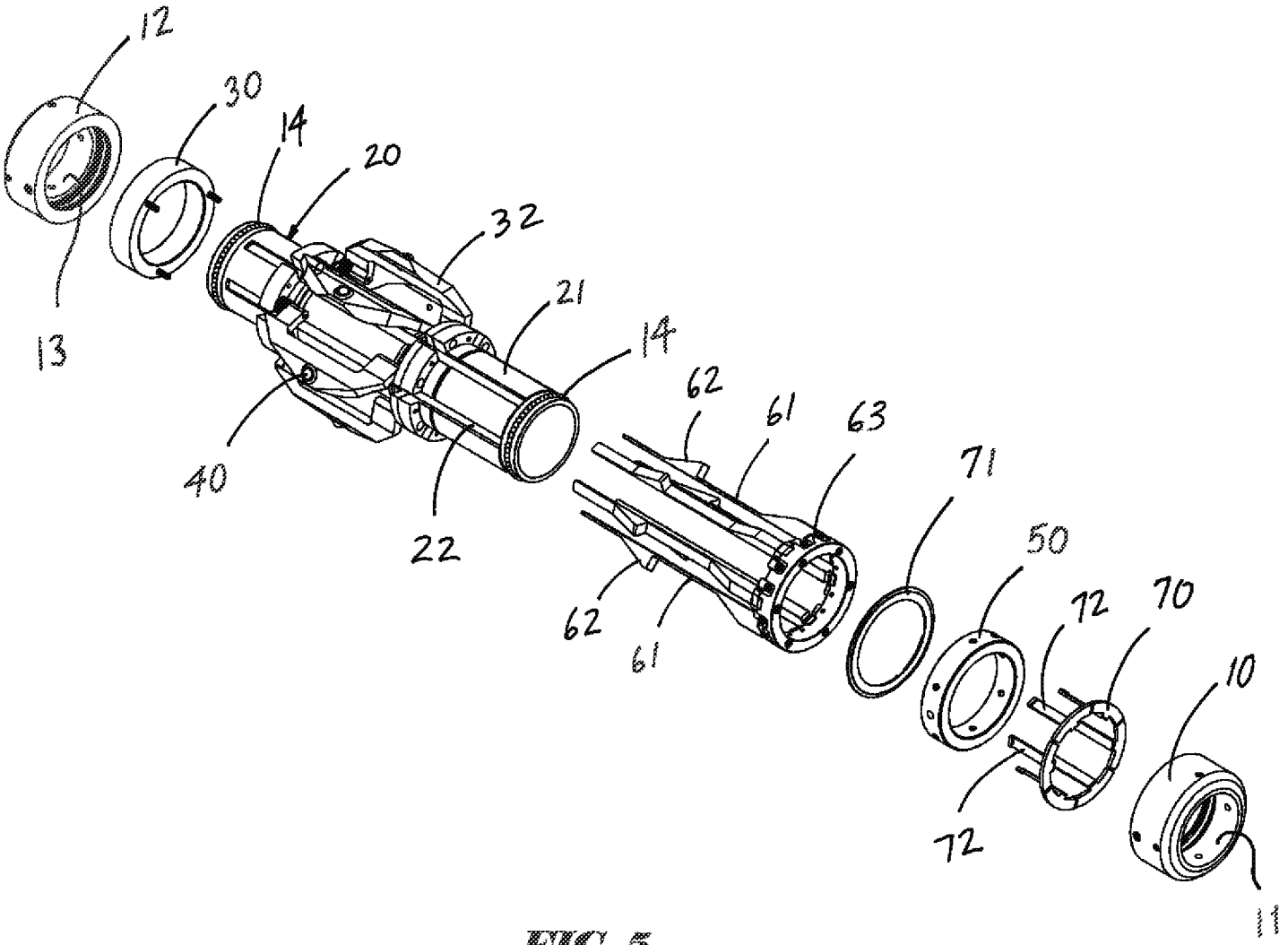
FIG. 5 depicts an exploded perspective view of an adjustable tension centralizer assembly of the present invention.

FIG. 5 depicts an exploded perspective view of adjustable tension centralizer assembly 100 of the present invention. In a preferred embodiment, said adjustable tension centralizer assembly 100 comprises first end connection member 10 having central through bore 11, as well as second end connection member 12 having central through bore 13. Substantially cylindrical body member 20 is disposed between said first end connection member 10 and second end connection member 12. Said substantially cylindrical body member 20 has outer surface 21 and central through bore 23, as well as bearings 14 disposed around the circumference of body member 20.

A plurality of elongate grooves 22 are disposed at desired spacing around the circumference of said outer surface 21; said elongate grooves 22 are oriented substantially parallel to the longitudinal axis of said body member 20. In a preferred embodiment, substantially cylindrical body member 20 is freely rotatable within said aligned bores 11 and 13 of end connection members 10 and 12, respectively. First centralizer end collar 30 and second centralizer end collar 31 are disposed around said cylindrical body member 20. A plurality of generally u-shaped centralizer arm members 32 are disposed between said first and second centralizer end collars and pivotally mounted to said first and second end collars.

At least one friction reducing omni-directional rolling element 40 is disposed on an outer surface of each such centralizer arm member 32. In a preferred embodiment, said friction reducing omni-directional rolling elements 40 comprise ball transfer units. Adjustable collar member 50 is slidably disposed on outer surface 21 of central body member 20 and, thus, is capable of moving axially along said central body member 20.

Wedge assembly 60 comprises base ring 63 as well as a plurality of track arms 61. Base ring 63 is slidably disposed over outer surface 21 of central body member 20, while track arms 61 are slidably received within longitudinal grooves 22 along said outer surface 21 of body member 20. Spring 71 is disposed between base ring 63 and collar member 50. Wedge latch member 70 having collet fingers 73 can connect to wedge assembly 60.

Tapered wedge members 62 are disposed on the outer surfaces of track arms 61; in a preferred embodiment, said wedge members 62 have a smaller thickness in the direction of first end connector 10, and a larger thickness in the direction of second end connector 12. Further, said tapered wedge members 62 are at least partially disposed under pivotally mounted centralizer arm members 32 (that is, between outer surface 21 of central body member 20 and said centralizer arm members 32).

Figure 6:
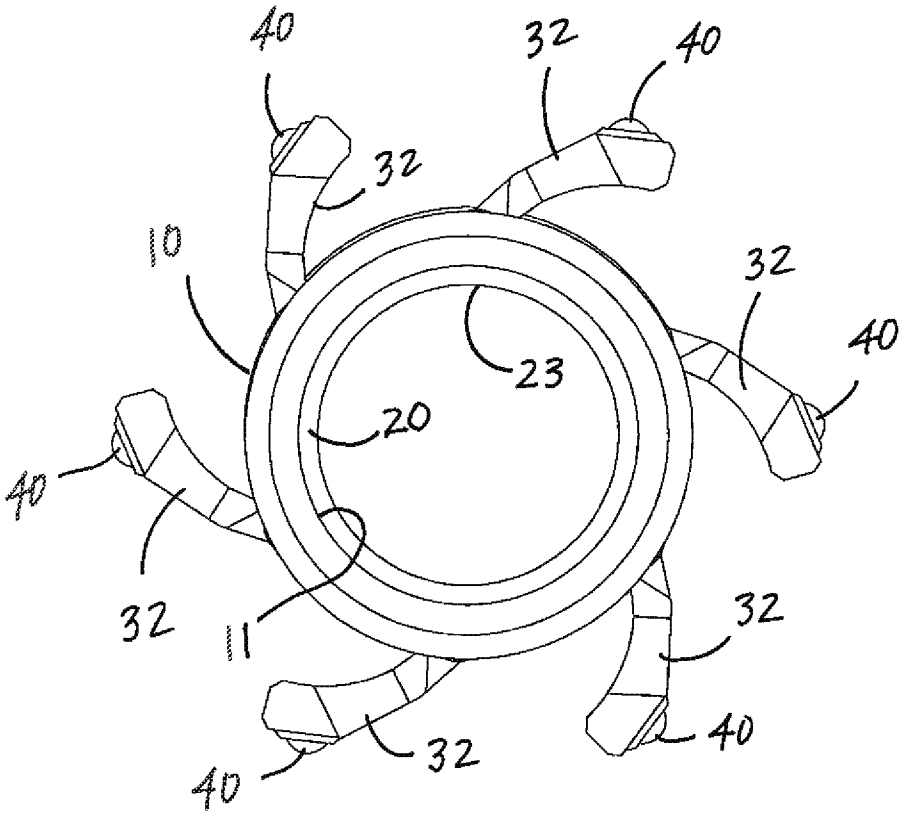
FIG. 6 depicts an end view of an adjustable tension centralizer assembly of the present invention with radially extending arms in an extended position.

FIG. 6 depicts an end view of adjustable tension centralizer assembly 100 of the present invention with centralizer arm members 32 in an extended position. First end connection member 10 has central bore 11. Body member 20 having central bore 23 is freely rotatable within said bore 11 of end connection member 10. Generally u-shaped centralizer arm members 32 are disposed around the outer surface of said body member 20; as depicted in FIG. 5, said centralizer arm members 32 are capable of pivoting radially outward from body member 20. At least one friction reducing omni-directional rolling element 40 is disposed on an outer surface of each such centralizer arm member 32.

Figure 7:
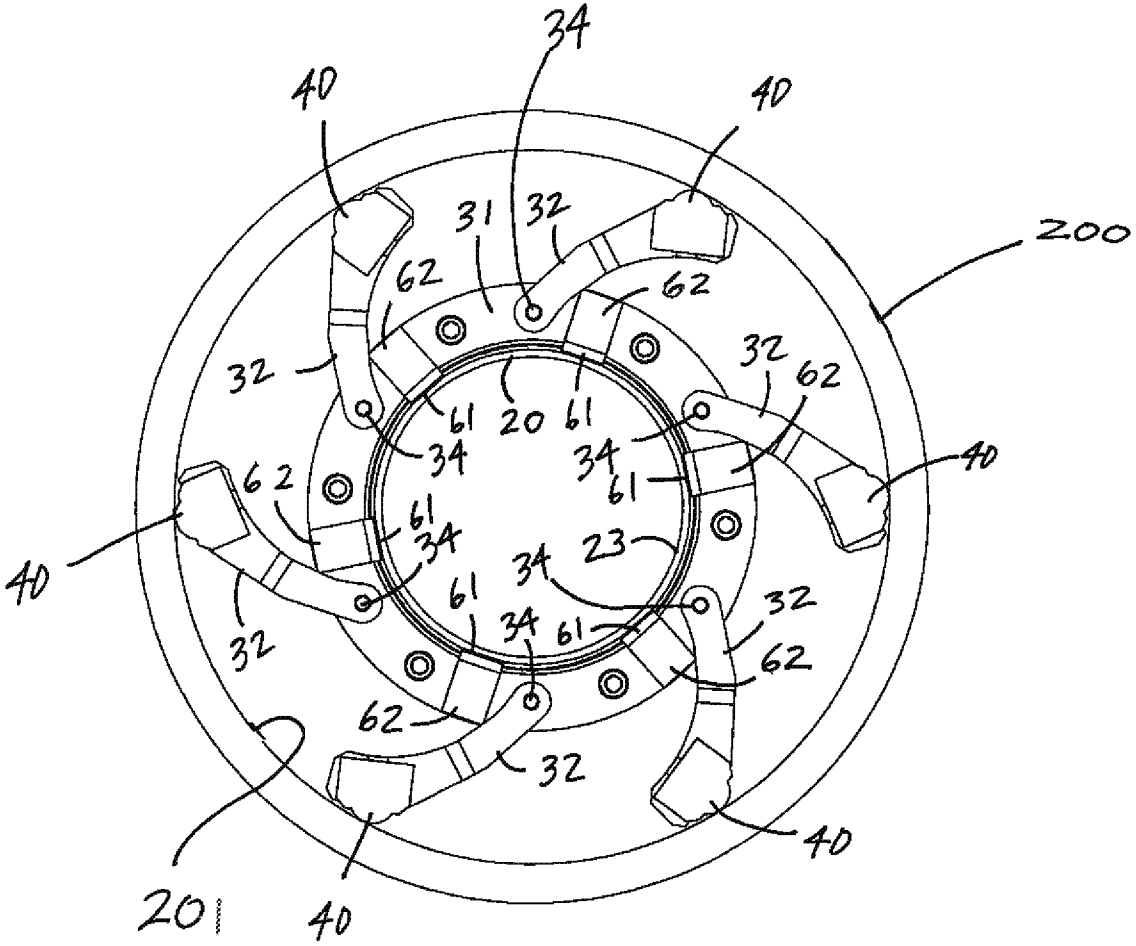
FIG. 7 depicts a sectional view of an adjustable tension centralizer assembly of the present invention along line 7-7 disposed within the inner bore of a pipe section with radial centralizer arms in an extended position.

FIG. 7 depicts a sectional view of adjustable tension centralizer assembly 100 of the present invention along line 7-7 of FIG. 3, disposed within a section of casing 200 having a central bore defining inner wall 201. Body member 20 has central bore 23; second centralizer end collar 31 is disposed around cylindrical body member 20. A plurality of centralizer arm members 32 are pivotally mounted to second centralizer end collar 31 (and first centralizer end collar 30, not depicted in FIG. 6) via pivot pins 34. Pivot pins 34 and, thus, the pivot axis of centralizer arm members 32, are oriented substantially parallel to the longitudinal axis of said body member 20.

Track arms 61 are slidably received within longitudinal grooves disposed along the outer surface 21 body member 20. Tapered wedge members 62 are disposed on the outer surfaces of track arms 61 and are at least partially disposed under pivotally mounted centralizer arm members 32 (that is, between outer surface 21 of central body member 20 and said centralizer arm members 32). At least one friction reducing omni-directional rolling element 40 is disposed on an outer surface of each such centralizer arm member 32. When centralizer arm members 32 are extended radially outward, said rolling elements 40 contact inner wall 201 of pipe section 200.

In operation, adjustable tension centralizer assembly 100 of the present invention can be installed at various locations along toolstrings, workstrings or other downhole assemblies. By significantly reducing sliding and rotational frictional forces, said adjustable tension centralizer assembly 100 allows such toolstrings, workstrings and/or other downhole assemblies to maneuver in and out of wells. By way of illustration, but not limitation, adjustable tension centralizer assembly 100 can be used to deploy packers, bridge plugs and other tools in horizontal or highly deviated wells, eliminating the need for pumping such equipment down such wells. Said adjustable tension centralizer assembly 100 greatly reduces the need to convey equipment in and out of wells using more expensive work strings and continuous tubing, thereby reducing rig down-time and operating costs.

Although adjustable tension centralizer assembly 100 can be included as part of a threaded string of tools or pipe, it is to be observed that said adjustable tension centralizer assembly will typically be received over the outer surface of a tool, tubular, pipe or similar device. When so configured, first end connection member 10 and second end connection member 12 are both secured to the outer surface of said tool, tubular or pipe section using set screws 15 or other fastening means; in this configuration, said tool, tubular or pipe section extends through central through bore 23 of body member 20, which is freely rotatable within said aligned bores 11 and 13 of end connection members 10 and 12.

As noted above, a plurality of generally u-shaped centralizer arm members 32 are disposed between said first and second centralizer end collars and pivotally mounted to said first and second end collars. Said centralizer arm members 32 are each pivotal about a pivot axis that is oriented substantially parallel to the longitudinal axis of said body member 20. As such, said centralizer arm members 32 are capable of pivoting radially outward from outer surface 21 of body member 20.

At least one friction reducing omni-directional rolling element 40 is disposed on an outer surface of each such centralizer arm member 32. In a preferred embodiment, said friction reducing omni-directional rolling elements 40 comprise ball transfer units. Adjustable collar member 50 is capable of moving axially along said central body member 20. As said adjustable collar member 50 move axially toward the midpoint of central body member 20, track arms 61 of wedge assembly 60 move within longitudinal grooves 22 along said outer surface 21 of body member 20.

As said track arms 61 move axially relative to central body member 20, tapered wedge members 62 also move axially under pivotally mounted centralizer arm members 32 (that is, between outer surface 21 of central body member 20 and said centralizer arm members 32). Said wedge members 62 force centralizer arm members 32 radially outward. In this manner, the outer diameter of said radially extending centralizer arm members 32 can be adjusted to a predetermined outer diameter by moving adjustable collar member 50. Once said centralizer arm members 32 are set to a desired location, adjustable collar member 50 can be secured in place.

The outer diameter formed by said cooperating radially extending centralizer arm members 32 can be quickly and easily adjusted, such as when a tool string employing said adjustable tension centralizer assembly 100 is used in multiple wells or pipe sizes having different inner diameters. Further, bias springs 33 permit limited inward movement of said centralizer arm members 32, such as when centralizer assembly 100 must pass through a downhole restriction or so-called "tight spot."

Figure 8:
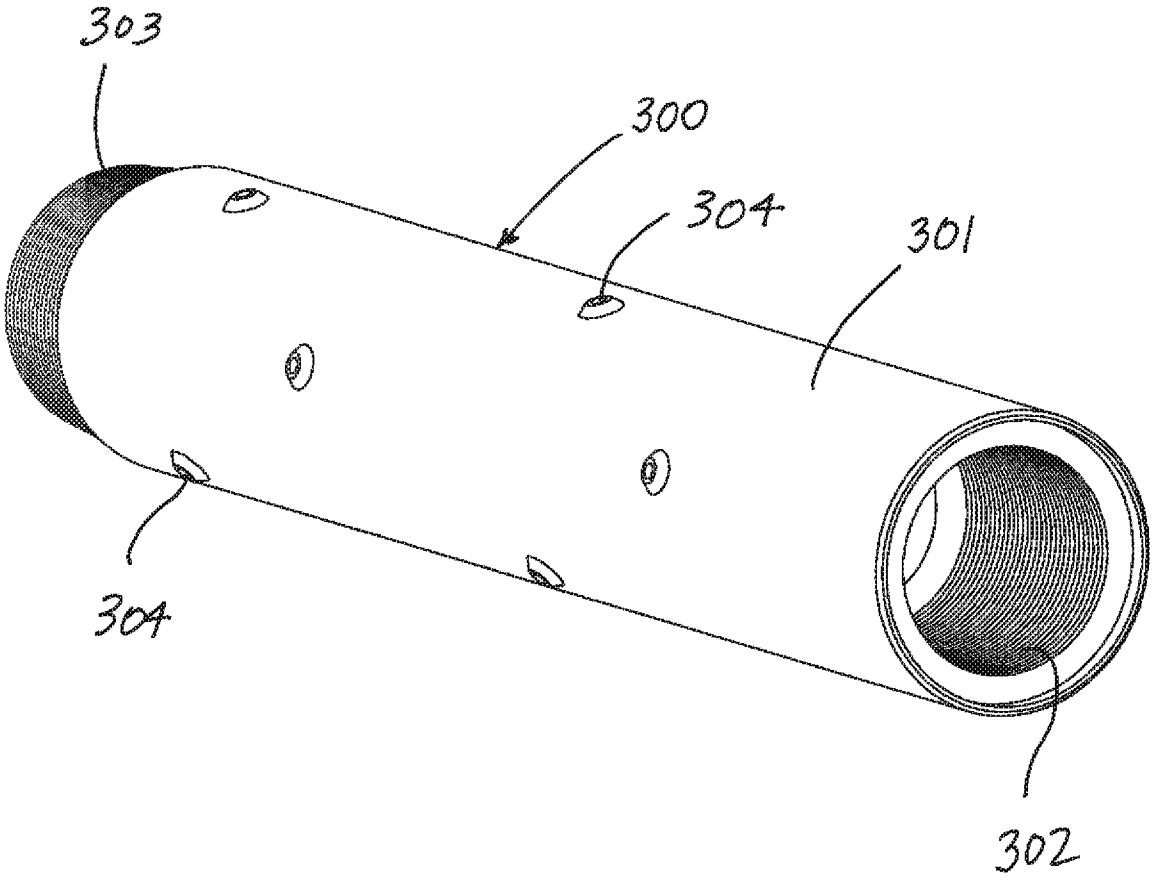
FIG. 8 depicts side perspective view of an alternative embodiment roller sub assembly of the present invention.

FIG. 8 depicts a side perspective view of an alternative embodiment rolling sub 300 of the present invention. Rolling sub 300 comprises cylindrical body member 301 having a central bore, as well as threaded end connection members 302 and 303. A plurality of omni-directional rolling elements 304 assist the delivery of tools, tubing, and pipe strings within a well, pipeline, or other similar environment. Rolling elements 304 are disposed along the outer surface of body section 301 of sub assembly 300 in order to reduce sliding friction and to allow sub assembly 300 to maneuver obstructions, such as commonly found in cylindrical pipe, casing, or uncased wells.

Sub assembly 300 of the present invention can be placed anywhere (typically by threaded connection) in a longer string of tubing/pipe/coiled tubing, and can be placed as frequently as needed along such length; rolling sub assembly 300 of the present invention can be included within a larger pipe assembly using threaded connections, set screws, or other connection means well known to those having skill in the art.

Roller sub assembly 300 ensures integrity of tubing and casing during their deployment. Mostly used in high deviated wells, the roller sub assembly reduces friction and torque. It incorporates a ball transfer system allowing full rotation and movement in all vertical, horizontal, and diagonal directions. Said roller sub assembly design allows full integrity without compromising pressure loss or the need to have external centralizers which can break or create fishing problems.

Uses for rolling sub assembly 300 of the present invention include, but are not limited to, reducing friction caused by a string scraping on the hole walls, assisting a string to traverse obstructions, minimizing internal scraping of walls, minimizing damage caused by a tool scraping on walls, and to allow a tool string freedom to rotate easier on the trip reducing pipe torsional strain. Rolling elements 304 can have varied configurations or placement on sub 300 including more concentration, varied concentrations, and configurations.

Figure 9:
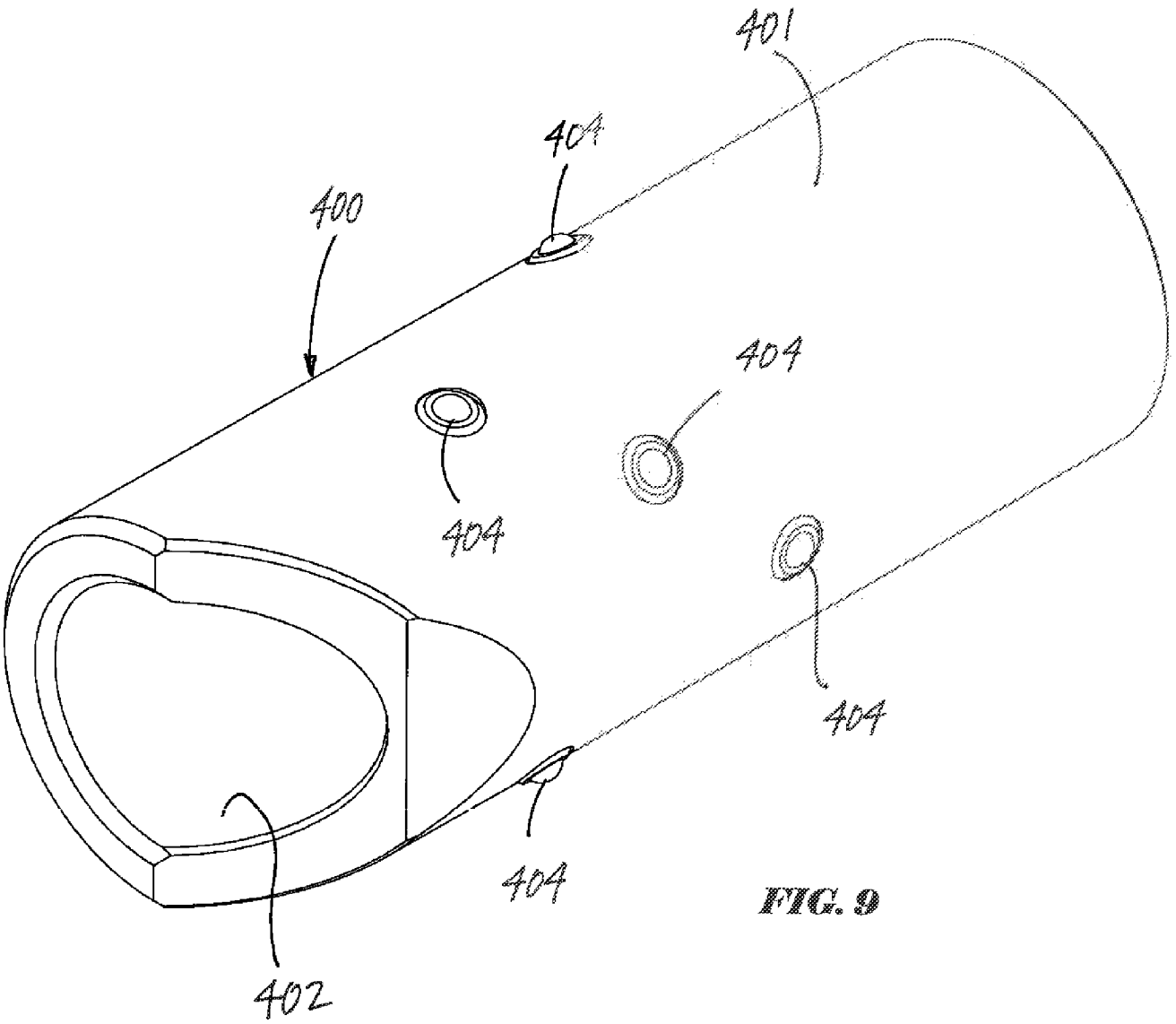
FIG. 9 depicts a side perspective view of an alternative embodiment muleshoe assembly of the present invention.

FIG. 9 depicts an alternative embodiment rolling muleshoe assembly 400 of the present invention. Muleshoe assembly 400 generally comprises cylindrical body member 401 having a central bore 402; although not visible in FIG. 9, muleshoe assembly 400 can include a threaded connection for attachment to a tool or pipe string. A plurality of omni-directional rolling elements 404 assist the delivery of tools, tubing, and pipe strings within a well, pipeline, or other similar environment. Rolling elements 404 are disposed along the outer surface of body section 401 of muleshoe assembly 400 in order to reduce sliding friction and to allow muleshoe assembly 400 to maneuver obstructions, such as commonly found in cylindrical pipe, casing, or uncased wells.

Muleshoe assembly 400 is typically placed on the distal end of a string of pipe, tubing, or other continuous conveyance means. The rolling mule shoe assembly of the present invention has a plurality of rolling 402 elements disposed along the outer surface of body member 401 of said mule shoe assembly 400 in order to reduce sliding friction and to allow the mule shoe assembly to maneuver obstructions, such as commonly found in cylindrical pipe, casing, or uncased wells.

Uses for the rolling mule shoe assembly 400 of the present invention include, but are not limited to, reducing friction caused by string scraping on the hole walls, assisting the string to traverse obstructions, minimizing internal scraping of walls, minimizing damaged caused by a tool scraping on walls, and to allow the tool string freedom to rotate easier on the trip reducing pipe torsional strain. Rolling elements 404 can have varied configurations on muleshoe body 401 including more concentrations, varied orientations, and configurations. Rolling mule shoe assembly 400 of the present invention can be included within a larger pipe assembly using threaded connections, set screws, or other connection means well known to those having skill in the art.

In a preferred embodiment depicted in FIG. 8, rolling mule shoe assembly 400 of the present invention helps ensure integrity of packers and bridge plugs during their deployment. Mostly used in high deviated wells, rolling mule shoe assembly 400 reduces friction and torque. In a preferred embodiment, rolling mule shoe assembly 400 beneficially incorporates a ball transfer system allowing full rotation in all vertical, horizontal, and diagonal directions. It also allows ease with deploying packers and bridge plugs on horizontal wells where equipment typically must be pumped down said wells, reducing rig down-time and rig costs. It also greatly reduces the need to run equipment using more expensive work strings and continuous tubing.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed is:

1. An adjustable centralizer assembly comprising:

a) a first connection member defining an inner bore;

b) a second connection member defining an inner bore;

c) an elongate body member having an outer surface and a longitudinal axis, wherein said elongate body member is rotatably disposed within said inner bores of said first and second connection members;

d) a plurality of centralizer members pivotally disposed along said outer surface of said elongate body member, wherein said centralizer members are adjustably extendable radially from said body member;

e) at least one wedge shaped member at least partially disposed between at least one centralizer member and the outer surface of said body member, wherein movement of said at least one wedge shaped member in a direction parallel to said longitudinal axis of said body member causes said at least one centralizer member to extend radially outward from said body member; and f) at least one omni-directional friction reducing element disposed on at least one of said centralizers, wherein said omni-directional friction reducing element comprises a ball transfer assembly.

2. The adjustable centralizer assembly of claim 1, further comprising at least one elongate groove extending along the outer surface of said body member, wherein said at least one elongate groove is oriented substantially parallel to said longitudinal axis.

3. The adjustable centralizer assembly of claim 2, wherein said at least one wedge shaped member is slidably disposed with said at least one elongate groove.

4. A rotatable centralizer assembly comprising:

a) a first collar member having a central bore;

b) a second collar member having a central bore;

c) a body member rotatably disposed within said bores of said first and second collar members;

d) a plurality of centralizer arms pivotally attached to said body member, wherein said centralizer arms are adapted to extend radially outward from said body member;

e) at least one omni-directional rolling element disposed on said centralizer arms; and f) at least one wedge shaped member at least partially disposed between said at least one centralizer arm and the outer surface of said body member, wherein said body member has a longitudinal axis and movement of said at least one wedge shaped member in a direction parallel to said longitudinal axis causes said at least one centralizer arm to extend radially outward from said body member.

5. The rotatable centralizer assembly of claim 4, further comprising at least one elongate groove extending along the outer surface of said body member, wherein said at least one elongate groove is oriented substantially parallel to said longitudinal axis.

6. The rotatable centralizer of claim 5, wherein said at least one wedge shaped member is slidably disposed with said at least one elongate groove.

7. The rotatable centralizer assembly of claim 4, wherein said at least one omni-directional rolling element comprises a ball transfer assembly.

8. The rotatable centralizer assembly of claim 4, wherein each of said centralizer arms comprise a substantially u-shaped member defining a first end and a second end, and wherein said first and second ends are pivotally mounted to said body member and pivot about a pivot axis that is substantially parallel to the longitudinal axis of said body member.

9. The rotatable centralizer assembly of claim 8, wherein said at least one omni-directional rolling element is adapted to contact a surrounding surface when said centralizer arms are extended radially outward from said body member.

10. The rotatable centralizer assembly of claim 4, further comprising bearings disposed between the central bore of said first collar member and said body member.

11. The rotatable centralizer assembly of claim 4, further comprising bearings disposed between the central bore of said second collar member and said body member.

* * * * *